United States Patent [19]

Kiernan

[11] Patent Number: 4,537,419

[45] Date of Patent: Aug. 27, 1985

[54] SKIING ACCESSORY

[76] Inventor: James T. Kiernan, 204 Washington Ave., Newtown, Pa. 18940

[21] Appl. No.: 557,207

[22] Filed: Dec. 2, 1983

[51] Int. Cl.[3] ..... A63C 11/00

[52] U.S. Cl. ..... 280/607; 280/809; 441/70

[58] Field of Search ..... 280/607, 817, 809, 601, 280/636; 24/70 SK, 71 SK; 441/70

[56] References Cited

U.S. PATENT DOCUMENTS

| | | | |
|---|---|---|---|
| 3,685,846 | 8/1972 | Schmid | 280/607 |
| 3,802,714 | 4/1974 | Freegard | 280/618 X |
| 3,854,738 | 12/1974 | Fish | 280/607 |
| 4,022,482 | 5/1977 | Powell | 280/601 X |

*Primary Examiner*—Joseph F. Peters, Jr.
*Assistant Examiner*—Michael Mar
*Attorney, Agent, or Firm*—Howson and Howson

[57] ABSTRACT

A device which enables a skier to ski safely on one ski. The device comprises a boot support plate releasably connected to the ski by means of a bracket carried thereon between its boot bindings. The boot support plate has a tongue received in the bracket and a laterally extending, upwardly-offset arm adapted to support the skier's free boot. A latch assembly is carried on the boot support plate and has an actuator disposed alongside the bound boot. The actuator is engaged by the bound boot as it pivots out of its bindings to release the boot support plate from its mounting bracket. A safety cable is provided to connect the boot support plate to the bracket.

11 Claims, 8 Drawing Figures

SKIING ACCESSORY

FIELD OF THE INVENTION

The present invention relates to skis, and more particularly, the present invention relates to an accessory for use with a snow ski to enable a skier to ski on one ski.

BACKGROUND OF THE INVENTION

To improve skiing ability, and to provide a challenge for good skiers seeking variety in their enjoyment of the sport, some skiers have found it desirable to ski on one ski with one boot fastened to the ski and with the other boot held free several inches above the snow surface. A skier alternates runs first with one boot fastened to the ski, and then with the other. Such technique has been used by skiers training for the Olympics to improve balance and leg strength.

BRIEF DESCRIPTION OF THE PRIOR ART

A device has been proposed to support one boot while the skier skis with the other boot attached to a ski. The device is disclosed in U.S. Pat. No. 4,022,482 and comprise a bracket fastened to a ski and an arm extending laterally from the bracket for supporting the skier's boot. An advantage of supporting one boot while skiing is that it permits the skier to use the muscles of both legs while skiing, and this is particularly important when turning and negotiating moguls. While the patented device may function satisfactorily for its intended purpose, the arm does not release automatically from the bracket in case of a fall.

Other devices which enable a skier to ski on one ski are disclosed in U.S. Pat. Nos. 3,854,738 and 3,685,846. In these devices, both boots are releasably fastened to a single ski. While such devices provide the advantage of enabling both boots to be firmly secured to the ski, they do not provide the advantages afforded by a device capable of supporting the skier's free boot while skiing.

OBJECTS OF THE INVENTION

With the foregoing in mind, a primary object of the present invention is to provide a novel accessory for enabling a skier to ski safely on one ski.

Another object of the present invention is to provide a unique device capable of being mounted on a conventional ski to enable a skier to ski with one boot fastened to the ski and the other boot supported alongside the ski to enable the skier to use both legs for power and control while skiing on one ski.

A further object of the present invention is to provide an improved device which enables a skier to support one boot alongside the other while skiing but which releases automatically to permit full release of the skier's other boot from its binding.

A still further object of the present invention is to provide a ski boot support device which is capable of being used with a conventional ski and which is reversible to enable the skier to ski safely with either one boot or the other fastened to the ski.

Another object of the present invention is to provide a relatively simple mechanism for releasably attaching a boot support to a ski in a manner which is resistant to malfunctioning due to clogging by snow and ice.

A still further object of the present invention is to provide a compact skiing accessory which can be stowed in a skier's pocket which not in use but which enables the skier to convert one of his conventional skis to either one-legged or two-legged skiing quickly and easily without requiring tools.

SUMMARY OF THE INVENTION

More specifically, the present invention provides an accessory for use with a conventional ski to enable a skier to ski with one boot fastened to the ski and with the other boot supported therealongside. The accessory comprises a boot support plate having a tongue disposed against the top of the ski between its toe and heel bindings and an upwardly-offset arm extending laterally outward of the ski at a higher level. A pair of bracket plates are mounted on opposite sides of the ski and have shaped surfaces cooperating with short flanges on the tongue to secure the tongue to the ski when engaged. A latch assembly is carried on the boot support plate and has an actuator with a pair of levers which releasably engage one of the bracket plates to disengage the tongue from the ski when the fastened boot pivots toward the free boot. A safety cable connects the boot support plate with one of the bracket plates to keep the boot support plate from being lost in the snow in the event of a release.

BRIEF DESCRIPTION OF THE DRAWINGS

The foregoing and other objects, features and advantages of the present invention should become apparent from the following description when taken in conjunction with the accompanying drawings, in which.

DESCRIPTION OF THE PREFERRED EMBODIMENT

Figure 1:
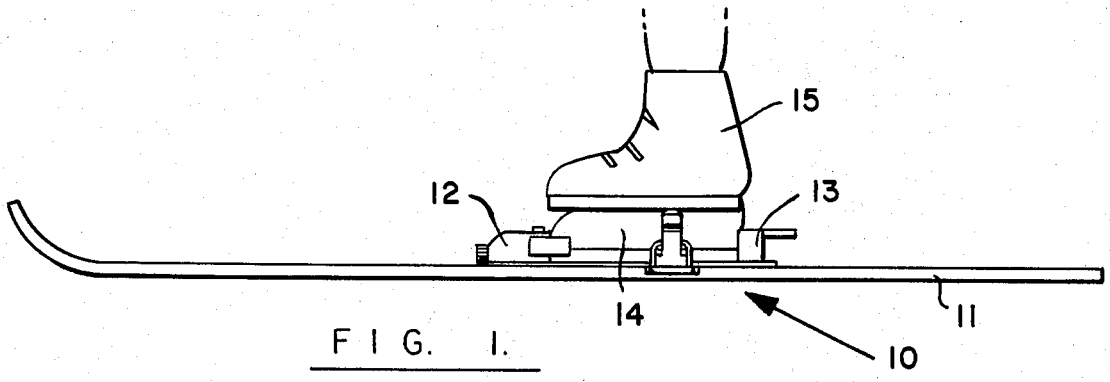
FIG. 1 is a side elevational view illustrating a ski to which is mounted a boot support accessory embodying the present invention, the view illustrating the left boot being supported on the accessory and the right boot fastened to the ski.

Referring now to the drawings, FIG. 1 illustrates a skiing accessory 10 which embodies the present invention. The accessory 10 is shown mounted on a conventional ski 11 having toe and heel bindings 12 and 13 mounted thereon in fore and aft spaced relation for releasably mounting a ski boot 14 therebetween. In the illustrated embodiment, the bindings 12 and 13 fasten the right boot 14 to the ski 11, and the left, or free boot 15 is supported on the accessory 10. In the present instance, the left boot 15 is not fastened to a ski. It should be understood, however, that if desired, the boot 15 may be fastened to the left ski and used to support the left ski above the right ski should the skier desire to ski in such a manner.

Figure 2:
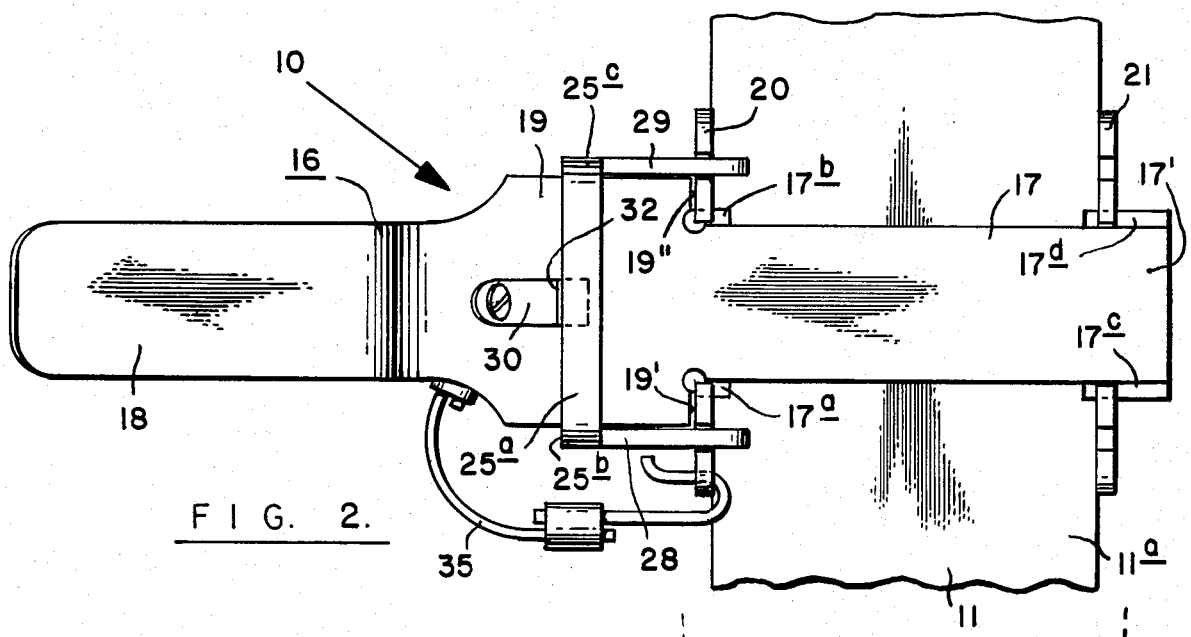
FIG. 2 is a plan view in full scale showing the accessory of the present invention mounted on a ski.
Figure 3:
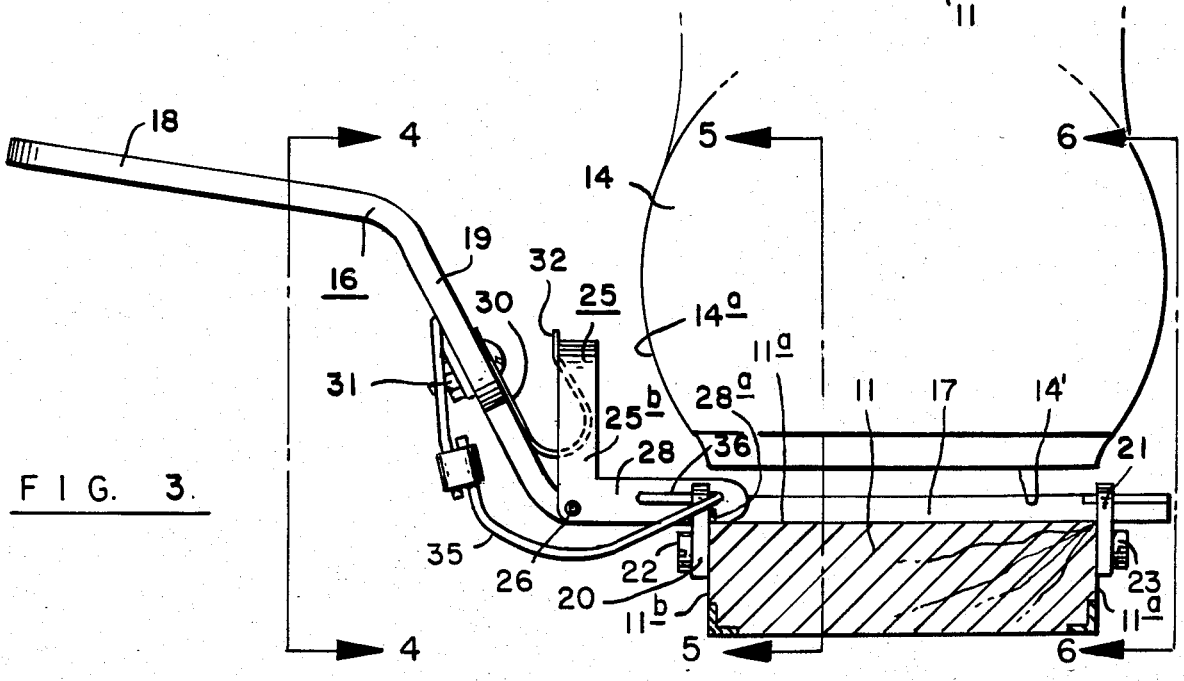
FIG. 3 is an elevational view of the accessory illustrated in FIG. 2.
Figure 4:
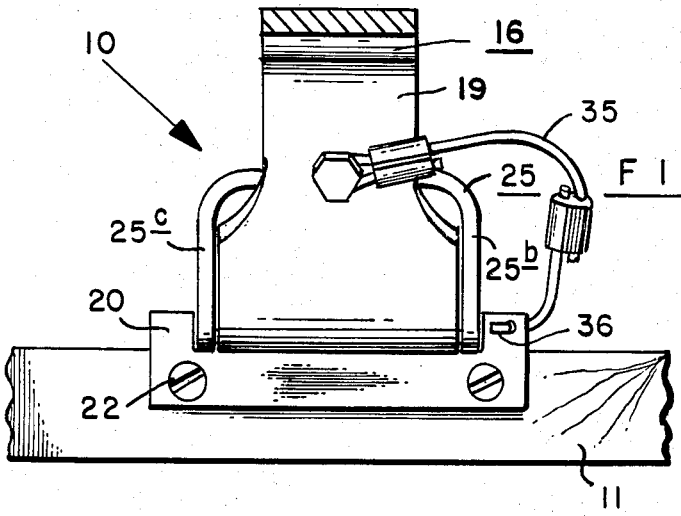
FIG. 4 is a sectional view taken on line 4—4 of FIG. 3.

According to the present invention, the ski accessory 10 comprises a boot support plate 16, bracket means 20 and 21 mounting the support plate 16 to the ski 11, and means including an actuator 25 and latch assembly 28,29 for automatically releasing the support plate to permit full release of the skier's bound boot from its bindings and thereby to reduce the possibility of the skier's being injured in the event of a fall. As best seen in FIGS. 2 and 3, the boot support plate 16 has a tongue 17 which overlies the top surface 11*a* of the ski 11 and a support arm 18 extending laterally of the ski 11 but offset upwardly therefrom at a higher level. The tongue 17 is connected to the arm 18 by an intermediate, integral transition portion 19 which, as best seen in FIG. 3, extends upwardly and outwardly with respect to the tongue 17 in spaced relation with the boot 14 when mounted in its bindings 12 and 13. Preferably, the boot support plate 16 is formed into the somewhat Z-shaped configuration illustrated in FIGS. 2 an 3 to cause the support arm 18 to be disposed about 2–3 inches above the top surface 11*a* of the ski 11 and to extend laterally outward about 5 inches beyond the left side 11*b* of the ski 11.

The accessory 10 does not interfere with the normal release of the boot 14 from its bindings 12 and 13. To this end, the tongue 17 is relatively thin, and as best seen in FIG. 3, the underside of the tongue 17 rests on the topside 11*a* of the ski 11 and underlies the bottom 14' of the boot 14. The spacing between the bottom 14' of the boot 14 and the top surface 11*a* of the ski 11 is determined by the thickness of toe and heel pads (not shown) normally mounted adjacent the toe and heel bindings 12 and 13, respectively. Thus, the spacing ensures that the boot 14 is capable of pivoting with respect to its bindings 12 an 13 and with respect to the tongue 17.

For the purpose of connecting the tongue 17 to the ski 11, bracket means is mounted on the ski 11 between the toe and heel bindings 12 an 13. In the present instance, the bracket means comprises a pair of bracket plates 20 an 21, and means mounting the bracket plates to the ski 11 in laterally spaced parallel relation. In the illustrated embodiment, the bracket plate mounting means includes the ski itself, the bracket plates 20 and 21 being mounted to opposite sides of the ski 11 by fasteners, such as the screws 22,22 connecting the bracket plate 20 to the left side 11*b* of the ski and the screws 23,23 connecting the bracket 21 to the right side 11*c* of the ski 11. As best seen in FIG. 3, the bracket plates 20 and 21 project upwardly a slight distance beyond the topside 11*a* of the ski 11 to mount the tongue 17 flush against the topside 11*a* of the ski 11. The height of the projection, however, must be small enough as not to interfere with the pivotal movement of the boot 14 with respect to its bindings 12 and 13. Preferably, the first bracket plate 20 is of identical construction to the second bracket plate 21 to afford economy of manufacture and reversibility as will be discussed.

Figure 5:
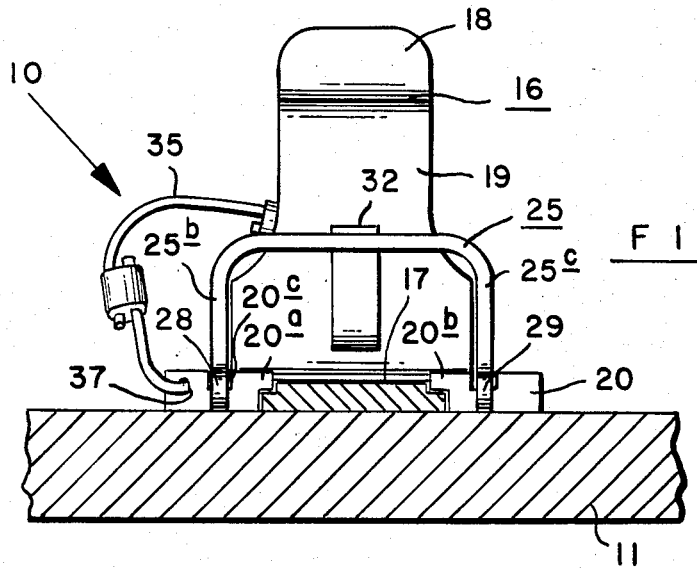
FIG. 5 is a sectional view taken on line 5—5 of FIG. 3.
Figure 6:
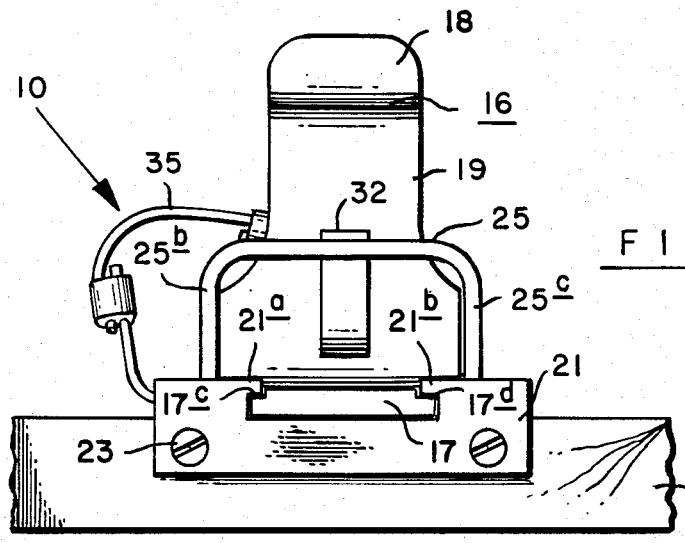
FIG. 6 is a sectional view taken on line 6—6 of FIG. 3.

The bracket plates 20 and 21 cooperate with the tongue 17 to fasten the boot support plate 16 to the ski 11 while affording ready release to permit full release of the skier's bound boot from its bindings and thereby to reduce the possibility of the skier's being injured in the event of a fall. For this purpose, surface means is provided by flanges on the tongue 17 for cooperating with surface means provided by shoulders on the bracket plates 20 and 21 to permit lateral sliding motion of the tongue 17 with respect to the bracket plates 20 and 21 while preventing fore and aft and upward motion with respect to the ski 11. As best seen in FIG. 5, each bracket plate, such as the bracket plate 20, has a shaped notch formed therein providing a pair of inturned shoulders 20*a* and 20*b* which overlie a pair of flanges 17*a* and 17*b*, respectively at opposite sides of the tongue 17 at the locations where it merges with the transition portion 19 of the support plate 16. The bracket plate shoulders 20*a* and 20*b* are separated by means of a gap which, as best seen in FIG. 2, is slightly greater than the width of the tongue 17 along the major portion of its length. This dimensioning of the tongue 17 with respect to the bracket gap permits the tongue 17 to pass upwardly through the gap when aligned. The flanges 17*a* and 17*b* are relatively short, about $\frac{1}{4}$ inch, and extend along opposite sides of the tongue for only a small fraction of its overall length. Also, the flanges 17*a* and 17*b* are only about one-half as thick as the tongue 17. A like pair of short, but slightly longer flanges 17*c* and 17*d* are provided adjacent to the tip 17' of the tongue 17. These flanges cooperate with shoulders 21*a* and 21*b*, respectively of the right hand bracket plate 21. Thus, when the tongue 17 is interengaged with the bracket plates 20 and 21 in the manner illustrated in FIG. 2, the boot support plate 16 is securely fastened to the ski 11. When thus fastened, the skier can exert substantial downward pressure on the support arm 18 since the upward reaction force on the tongue 17 is restrained by the right bracket plate 21. Pivotal movement of the support plate 16 with respect to the topside of the ski is restrained by the cooperation of the bracket plates 20 and 21 with the tongue 17.

The tongue 17 is engaged with the bracket plates 20 and 21 simply by sliding the boot support plate 16 rightward along the topside 11*a* of the ski 11 with the tongue 17 aligned with the notches in the bracket plates 20 and 21. Inward sliding motion of the tongue 17 is limited by stop surfaces 19' and 19'' which extend laterally of the transition portion 19 of the boot support plate 16 and which engage the left bracket plate 20 when the tongue 17 is inserted all the way across the ski 11.

To disengage the support plate 16 from the ski 11, the tongue 17 must first be slid leftward a slight distance until its flanges 17*a*—17*d* disengage their respective bracket plates 20 and 21. For example, as soon as the flanges 17*c* and 17*d* disengage the bracket plate 21, the tongue 17 is capable of moving upwardly through the gap between the shoulder 20*a* and 20*b* in the left bracket plate 20 since the slightly shorter flanges 17*a*, 17*b* will have cleared the shoulders in the left bracket plate 20 to afford complete separation from the ski 11.

The accessory 10 can be used with a variety of skis. For this purpose, the tongue 17 has a predetermined length which, in the illustrated embodiment, is greater than the width of the illustrated ski 11 so that the free end 17*a* of the tongue 17 extends a slight distance beyond the right hand side 11*c* of the ski 11. A preferred tongue length is about 3 inches. This length of the tongue 17 enables the accessory 10 of the present invention to be used on conventional skis of various widths.

In accordance with the present invention, means is provided for sensing incipient release of the boot 14 from its bindings 12 and 13 and automatically releasing the support plate 16 from the bracket plates 20 and 21 in order to prevent the boot support plate 16 from interfering with the normal release of the boot 14 from its bindings 12 and 13. To this end, the automatic release means comprises an actuator 25 which projects upwardly from the tongue 17 outboard of the first bracket plate 20 to the left side 11*b* of the ski 11. As best seen in FIG. 3, the actuator 25 is normally spaced from the left side, or instep, 14*a* of the mounted boot 14 such that the actuator 25 is normally not engaged by the boot 14 until after the boot 14 has pivoted leftward through a predetermined angle in the course of being released by the toe binding 12. As a result, the boot support plate 16 does not interfere with the normal release movement of the bound boot 14.

As best seen in FIG. 2, the actuator 25 is in the shape of a bail having a horizontally extending portion 25*a* and a pair of depending legs 25*b* and 25*c* which are pivotally connected to the tongue 17 by aligned pins 26 located adjacent to their lower ends at the point where the tongue 17 merges with the transition portion 19 of the support plate 16. The pins 26 mount the actuator 25 to pivot about a horizontal axis disposed parallel with the lengthwise dimension of the ski but outboard thereof.

For the purpose of retaining the tongue 17 engaged with the bracket plates 20 and 21 until the actuator 25 is pivoted, latch means is provided on the tongue 17 and first bracket plate 20. The latch means cooperates with the actuator 25 to enable the tongue 17 to be slid rightward for engaging the tongue 17 with the bracket plates 20 and 21 and slid leftward to effect disengagement in response to conterclockwise pivotal movement of the actuator 25. To this end, the latch means includes a pair of levers 28 and 29 connected to the depending legs 25*b* and 25*c*, respectively of the actuator 25 for pivoting therewith about the pivot axis provided by the pins 26. The levers 28 and 29 extend laterally inward beyond the bracket plate 20 a slight distance inwardly of the left side edge 11*b* of the ski 11. Each lever, such as the lever 28 is provided with a rounded end and a downwardly open notch 28*a* which is received in an upwardly open notch 20*c* provided in the bracket plate 20. The lever 29 is provided with a similar notch as is the corresponding portion of the bracket plate 20. Thus, the notches in the levers 28 and 29 engage the notches in the bracket plate 20 to prevent the tongue 17 from sliding leftward with respect to the bracket plates 20 and 21 and thereby inadvertently disengaging the ski 11.

To insure positive interengagement of the lever notches with the notches in the bracket plate 20, means is provided for biasing the levers 28 and 29 clockwise. In the illustrated embodiment, the biasing means is provided by a spring element 30 which is interposed between the transition portion 19 of the boot support plate 16 and the actuator 25. Preferably, the spring element is fastened to the transition portion 19 of the plate 16 by a bolt 31 and has an upturned free end 32 which engages the actuator 25 and applies pressure in the clockwise direction thereto.

Figure 7:
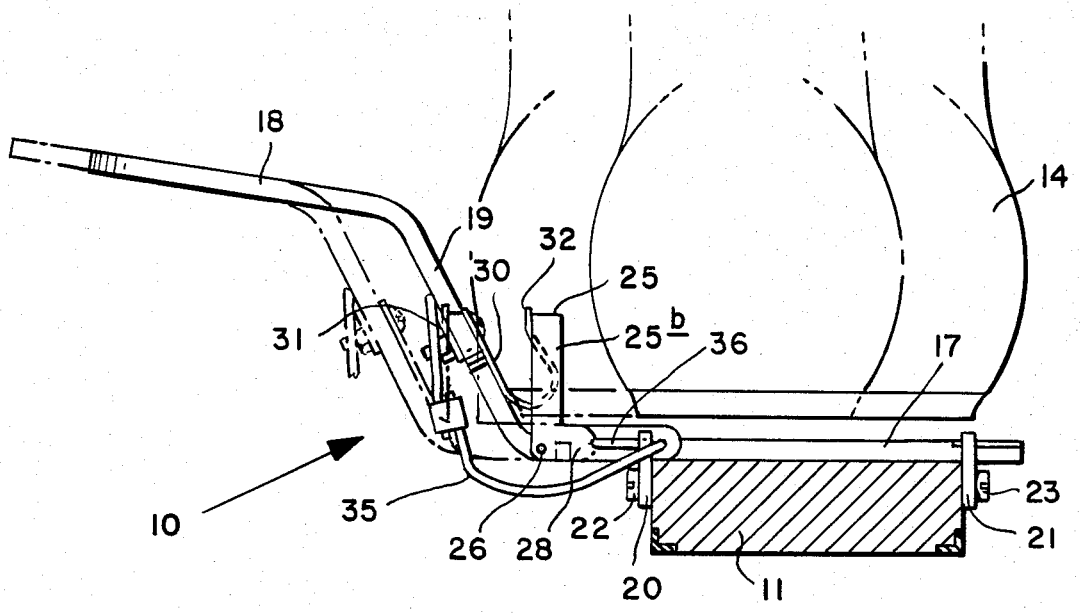
FIG. 7 is a view similar to FIG. 3 but illustrating the boot support plate in the process of being disengaged from its mounting brackets on the ski.

To install the boot support plate 16, the skier grips the transition portion 19, and with his thumb pivots the actuator 25 counterclockwise (FIG. 3) and aligns the tongue 17 with the bracket plates 20 and 21. He then slides the tongue 17 rightward across the top 11*a* of the ski 11 to engage the tongue flanges 17*a*–17*d* with the brackets 20 and 21. After the stop surfaces 19' and 19'' engage the left bracket plate 20, the actuator 25 is released. Thus, in use, the support plate 16 is engaged with the bracket plates 20 and 21 in the manner illustrated in FIGS. 2 and 3, and in the manner illustrated in full lines in FIG. 7. When thus engaged, a skier can support the left boot 15 on the plate arm 18 and ski with the other boot 14 fastened between the toe and heel bindings 12 and 13 on the ski 11. To disengage the support plate 16, the actuator 25 is gripped by the skier and again pivoted while sliding the tongue 17 leftward across the top 11*a* of the ski 11. The support plate 16 can then be stowed in the skier's pocket when not in use.

Figure 8:
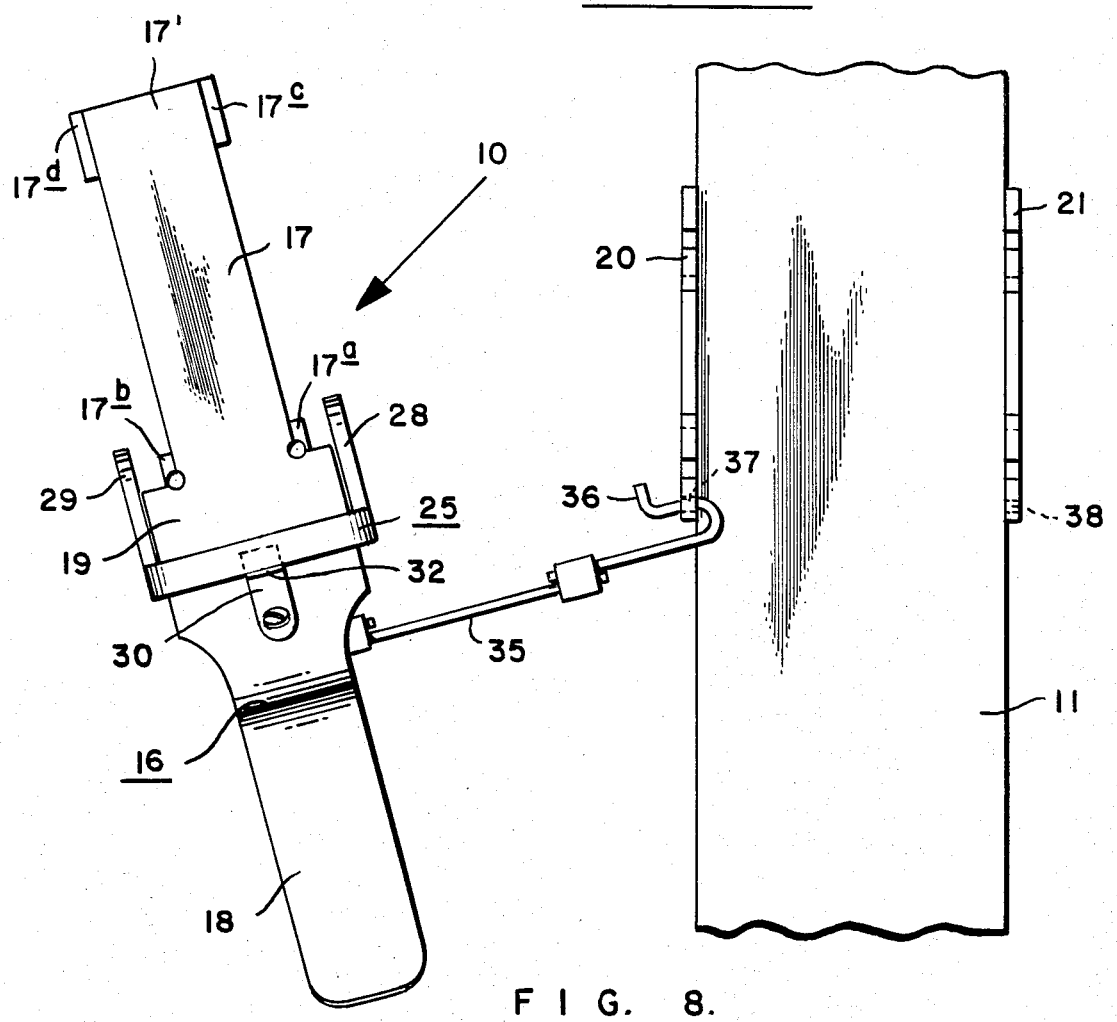
FIG. 8 is a plan view illustrating the boot support plate of the present invention disengaged from its mounting brackets.

In the event that the skier should encounter some difficulty, such as might precipitate a fall which would cause the boot 14 to pivot leftward, the boot 14 engages the actuator 25 and pivots the same counterclockwise against the bias of the spring element 30. This causes the levers 28 and 29 to pivot upwardly for disengaging their notches from the notches in the bracket plate 20. Continued pivotal movement of the boot 14 against the actuator 25 displaces the boot support plate 16 leftward into the broken line position illustrated in FIG. 7 until such time as the flanges 17*a*–17*d* on the tongue 17 disengage their respective bracket plates 20 and 21. By that point in time, the boot 14 will already have been released by the toe and heel bindings 12 and 13, and by virtue of the relative size of the tongue 17 and the size of the notches in the bracket plates 20 and 21, the tongue 17 is capable of moving upwardly and disengaging the bracket plates 20 and 21 and swinging free of the ski 11 such as into the position illustrates in FIG. 8. As a result, the boot support plate 16 does not interfere with the normal release movement of the bound boot 14 from its bindings 12 and 13.

To prevent the boot support plate 16 from becoming totally disconnected from the ski 11 and lost in the snow, a safety cable 35 is provided. As best seen in FIGS. 2 and 3, the safety cable 35 is fastened to the support plate 16 by the spring mounting bolt 31 and is fastened to the first bracket 20 by a shaped terminal end 36 received in a hole 37 provided in the bracket plate 20. The terminal end 36 of the safety cable 35 is provided by a wire form which has a serpentine bend shaped to provide a secure connection between the bracket plate 20 and the support plate 16 while affording manual disconnection upon manipulation of the end 36 with respect to the bracket plate 20. The safety cable is preferably connected to the bracket plate 20 prior to insertion of the tongue 17 in the brackets 20 and 21.

The boot support plate 16 is reversible to allow the skier to support either the left boot or the right boot while skiing. This is afforded by virtue of the similarity in configuration of the bracket plate 20 with the bracket plate 21, and the arrangement of the flanges 17*a*–17*d* on the tongue 17. As a result of this structure, the boot support plate 16 may be installed either with the support arm 18 extending leftward as illustrated in FIG. 2 or with the support arm 18 extending rightward. When reversed, the terminal end 36 of the safety cable 35 is threaded through the hole 38 in the right hand bracket plate 21, and the tongue 17 is slid leftward to engage it with the bracket plates 20 and 21. Should reversibility not be desired, the right boot bracket plate 21 could be provided with an aperture, rather than the notch as illustrated, in which event the tip flanges 17*c* and 17*d* would be eliminated.

In the disclosed embodiment, the accessory 10 is fabricated of stainless steel. It should be apparent, however, that the accessory 10 may be molded of any of a number of high strength plastic materials such as the ultra-high molecular weight engineering plastics currently readily available.

In view of the foregoing, it should be apparent that the present invention now provides an improved accessory capable of being used on a conventional ski to enable a skier to ski safely with one boot fastened to the ski while supporting the other boot alongside the ski. The boot support plate 16 can be engaged and disengaged quickly without tools and is compact enough as to be carried in the skier's pocket when not in use. Moreover, the support plate 16 is readily reversible.

While a preferred embodiment of the invention has been described in detail, various modifications, alterations and changes may be made without departing from the spirit and scope of the present invention as defined in the appended claims

I claim:

1. For use with a ski having bindings for releasably retaining one boot, a device for supporting another boot alongside and ski while skiing comprising:

a plate having a tongue adapted to overlie said ski and an arm ofset upwardly from said tongue and extending laterally therefrom for supporting said other boot, bracket means mounted to said ski for releasably connecting said tongue thereto, and means for sensing release movement of said one boot with respect to its bindings and automatically releasing said tongue from said bracket means, including an actuator disposed adjacent to said one boot, means mounting said actuator for movement when engaged by said one boot, and latch means operable in response to movement of said actuator to permit disengagement of said tongue from said bracket means.

2. A device according to claim 1 wherein said actuator projects upwardly above said tongue alongside said one boot and is mounted to pivot when engaged by said one boot.

3. A device according to claim 2 wherein said bracket means includes at least one plate having a shaped notch defining a pair of inturned shoulders spaced apart by a gap disposed lengthwise of the ski, flange means extending along a portion of said tongue for normally engaging said shoulders to prevent upward movement of said tongue relative to said ski, said bracket plate gap being dimensioned with respect to said tongue to permit said tongue to pass upwardly therethrough when said flange means is disengaged from said bracket shoulders in response to outward movement of said one ski boot.

4. A device according to claim 3 wherein said one bracket plate is mounted to said ski adjacent the side thereof from which said support arm extends, and said bracket means further includes another plate mounted adjacent the opposite side of said ski and having means for receiving said tongue adjacent its free end.

5. A device accordng to claim 4 wherein said means in said other plate includes a notch similar in configuration to said notch in said one plate, and said tongue has flange means adjacent its tip similar in construction to said first-mentioned flange means and similarly received in said other plate notch.

6. A device according to claim 2 wherein said latch means includes lever means connected to said actuator for movement in response thereto, interengaging surface means on said lever means and bracket means cooperable to prevent lateral movement of said tongue relative to said ski when engaged, and means for normally biasing said lever and bracket surface means into said interengaged relation.

7. A device according to claim 6 wherein said actuator includes a bail extending widthwise of said tongue and having a pair of downturned legs, said lever means includes a pair of levers connected to said legs and extending along opposite sides of said tongue, and including means mounting said bail and levers for pivotal motion about an axis extending alongside the ski.

8. A device according to claim 7 wherein said support plate has an upwardly and outwardly inclined transition section connecting said arm and tongue, said actuator bail is disposed alongside said transition section, and said biasing means includes a spring element interposed between said transition section and said actuator bail.

9. A device according to claim 3 including a safety cable permanently connected to said support plate and releasably connected to said first bracket plate.

10. For use in combination with a ski having bindings for releasably retaining one boot thereon, a device for supporting the other boot alongside said one boot while skiing, said device comprising a boot support arm extending laterally outward from said ski at a level higher than said ski for supporting the other boot thereon, a mounting tongue extending inwardly of said arm for overlying said ski and underlying said one boot, bracket means carried by said ski for receiving said mounting tongue, latch means cooperating with said bracket means to releasably retain said mounting tongue engaged therewith, and latch actuator means adapted to be engaged by said one boot in response to movement thereof relative to its bindings for cooperating with the latch means to release the boot support arm automatically from the ski.

11. An accessory for use while skiing to enable a skier to support one boot alongside another while skiing on one ski having bindings releasably retaining the other boot thereon, said accessory comprising:

first and second bracket plates, means mounting said plates in laterally spaced relation to said ski, a boot support assembly releasably retained by said bracket plates, said boot support assembly including a support plate having a tongue portion extending laterally across said ski for engaging said bracket plates, a transition portion offset upwardly from said tongue portion adjacent to said first bracket plate, and an arm portion extending laterally outward from said transition portion at a higher level than said tongue portion, said tongue and said bracket plates having shaped surfaces cooperating in one position of said tongue to prevent movement of said tongue relative to said ski and in another laterally outwardly displaced position of said tongue to permit upward movement of said tongue relative to said bracket plates, said boot support assembly further including a latch assembly carried by said support plate, said latch assembly including a pair of levers extending along opposite sides of said tongue and complementary notches in said levers and said first bracket plate for normally fastening said tongue in said one position, an actuator connecting said levers and projecting upwardly therefrom between said transition portion of said support plate and said other boot, means pivotally mounting said levers and actuator to said support plate laterally outward of said first bracket plate, and means biasing said lever notches into engagement with their complementary notches in said first bracket plate, whereby pivotal release movement of the other boot toward the boot support arm displaces the actuator and disengages the lever notches for disconnecting the tongue from the bracket plate.

* * * * *